US007413228B2

(12) United States Patent
Tong

(10) Patent No.: US 7,413,228 B2
(45) Date of Patent: Aug. 19, 2008

(54) HARD FLEX TWEEZERS

(76) Inventor: Kam Por Paul Tong, 24/F., Flat C, Block 1, Victoria Centre, 15 Watson Road, Hong Kong (HK)

( * ) Notice: Subject to any disclaimer, the term of this patent is extended or adjusted under 35 U.S.C. 154(b) by 348 days.

(21) Appl. No.: 10/429,621

(22) Filed: May 5, 2003

(65) Prior Publication Data

US 2004/0222653 A1 Nov. 11, 2004

(51) Int. Cl.
*B25B 9/02* (2006.01)

(52) U.S. Cl. ..... 294/99.2; 294/902

(58) Field of Classification Search ..... 294/99.1, 294/99.2, 902; 81/3.8, 9.44; 30/90.1, 91.2
See application file for complete search history.

(56) References Cited

U.S. PATENT DOCUMENTS

| | | | | | |
|---|---|---|---|---|---|
| 533,923 | A | * | 2/1895 | Seyfriedt | 294/99.2 |
| 1,018,788 | A | * | 2/1912 | Stone | 294/99.2 |
| 1,521,689 | A | | 1/1925 | King | |
| 2,346,537 | A | | 4/1944 | Fernandez | |
| 2,802,211 | A | * | 8/1957 | Friedman | 294/99.2 |
| 2,894,424 | A | * | 7/1959 | Vaughan, Jr. | 294/99.2 |
| 3,167,981 | A | | 2/1965 | Kern | |
| 3,291,476 | A | * | 12/1966 | Calkin | 294/99.2 |
| 3,321,736 | A | * | 5/1967 | Flynn | 294/99.2 |
| 3,628,824 | A | | 12/1971 | Leuw | |
| 4,484,581 | A | * | 11/1984 | Martin et al. | 606/158 |
| 4,541,311 | A | * | 9/1985 | Trammell, Jr. | 294/99.2 |
| 4,852,925 | A | * | 8/1989 | Lodin | 294/99.2 |
| 5,078,729 | A | * | 1/1992 | Eichhorn | 294/99.2 |
| 5,147,368 | A | | 9/1992 | Brown | |
| 5,387,019 | A | | 2/1995 | Britzke | |
| 5,472,450 | A | * | 12/1995 | Mena | 294/99.2 |
| 6,804,869 | B1 | * | 10/2004 | Tong | 294/99.2 |
| 2004/0010905 | A1 | * | 1/2004 | Denter et al. | 29/566.4 |

FOREIGN PATENT DOCUMENTS

| | | |
|---|---|---|
| FR | 2 797 796 | 3/2001 |
| JP | 2003-258075 | 3/2002 |

* cited by examiner

*Primary Examiner*—Saul J. Rodriguez
*Assistant Examiner*—Paul T Chin
(74) *Attorney, Agent, or Firm*—Schweitzer Cornman Gross & Bondell LLP

(57) ABSTRACT

An improved tweezers, particularly adapted for grasping small parts, has a first arm and a second flexible arm joined together at first ends to form a pair of tweezer jaws at second ends. A flexing of the flexible arm is accommodated as by incorporation of an arcuate portion of the first arm such that, when the arm is flexed by the application of a force, the jaw end of the flexible arm is displaced from jaw end of the first arm to open the tweezer jaws. When the force is removed, the flexible jaw returns to a rest position to apply a gripping force to an object between the jaws.

12 Claims, 7 Drawing Sheets

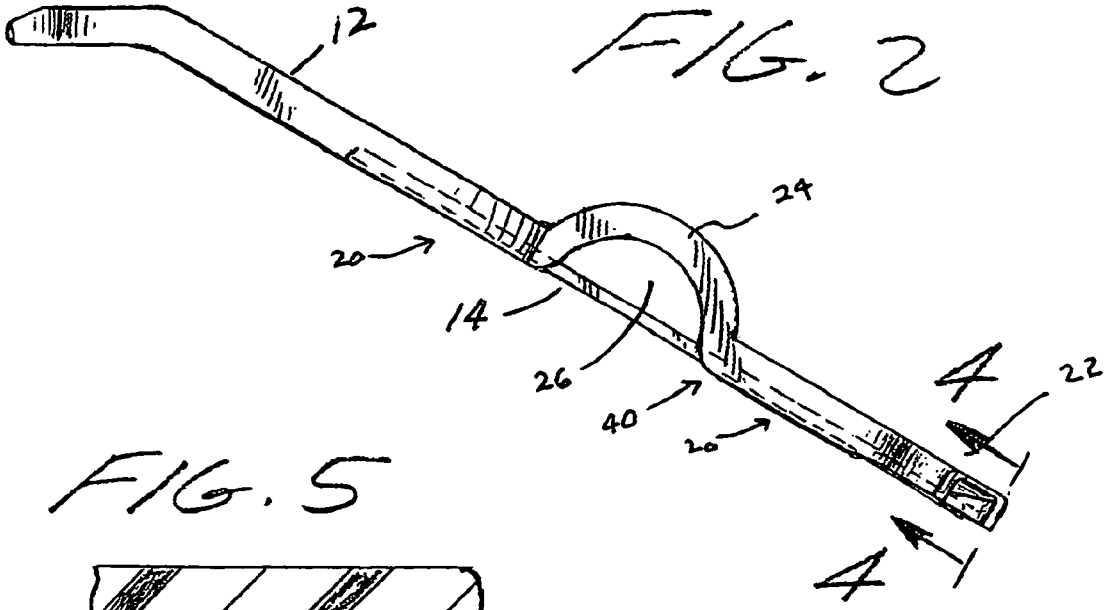
FIG. 2
FIG. 5
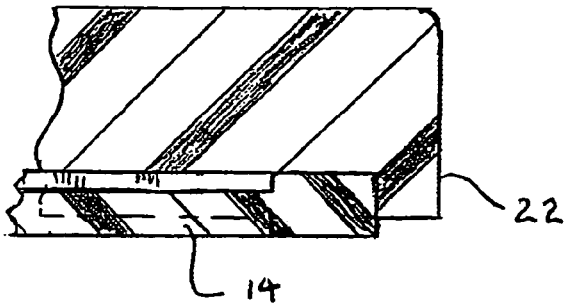
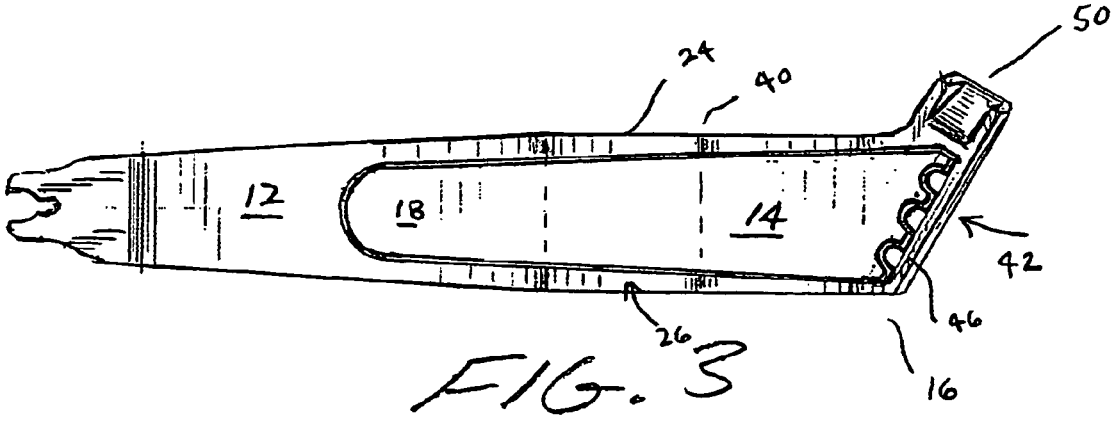
FIG. 3

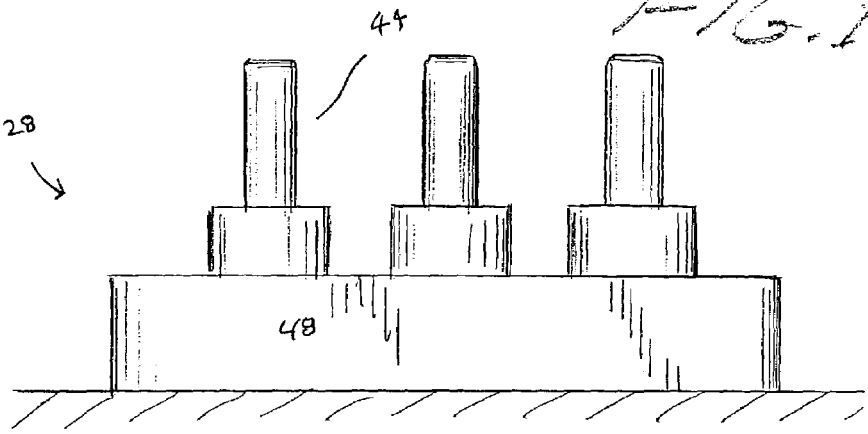
FIG. 13
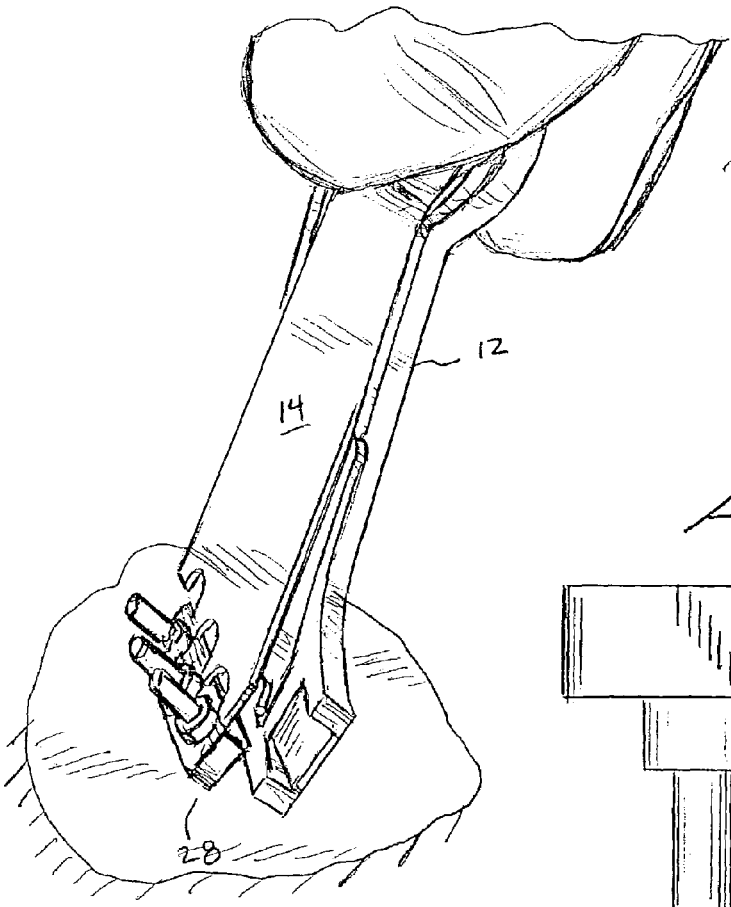
FIG. 14
FIG. 15
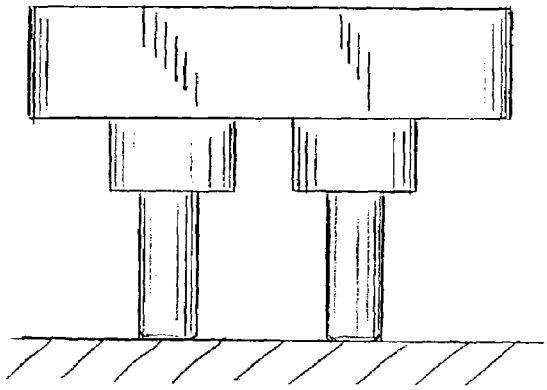

HARD FLEX TWEEZERS

The present invention relates to a new and improved tool, and particularly to a tool that has a specialized utility for grasping and manipulating small parts.

BACKGROUND OF THE INVENTION

Numerous tweezers or grasping tool constructions are known. A conventional tweezer-like device comprises a pair of flexible arms joined at their first ends, with the second, opposed ends assuming a spaced-apart rest position. The arms are manually held and squeezed by the user in order to grasp an object oriented between the open ends. When it is desired to release the grasped object the grip on the arms is released.

Such tweezers allow for increased flexibility and precision in the manipulation of small objects and thus have wide use potential. In the crafts arts, for example, mosaic construction projects often utilize a plurality of small, peg-like elements, which are assembled in a desired manner in a grid-like matrix. The manipulation and insertion of individual pegs can require a fair amount of manual dexterity. The use of a tweezer-like device to grip and manipulate the pegs can be of great assistance.

Conventional tweezers, however, remain of limited applicability. It is often difficult to grip a peg in an appropriate manner to be inserted into the matrix without manual intervention to reorient the grip of the tweezers on the peg. In addition, conventional tweezers require that pressure be maintained on the tweezer arms on a continual basis to maintain grip of the peg. This may be difficult and uncomfortable, particularly for a child. In addition, pegs of arts and craft sets often are provided in an initially massed or connected arrangement, requiring the pegs to be individually separated for use. It would be of benefit to have a tool which can assist in this separation and subsequently be used to grip the pegs.

Further, because of the necessity for exerting an insertion force upon a peg while placing it in a matrix, it can be impractical or difficult to exert such an insertion force on a peg when gripped by a conventional pair of tweezers in which an inward gripping force to hold the peg by the tweezers must be maintained.

It is accordingly a purpose of the present invention to provide a tweezer-like tool which has increased convenience in connection with the maintenance of a continuing grip on a small item, such as a peg.

A further purpose of the present invention is to provide a tweezer-like tool in which continued finger pressure is not required to maintain the tweezers' grip upon a held item.

Another purpose of the present invention it is to provide a new and improved tweezer-like tool which can incorporate additional tool functions therein.

A still further purpose of the present invention is to provide a tweezer-like tool which is of economical manufacture and construction.

BRIEF DESCRIPTION OF THE INVENTION

In accordance with the foregoing and other objects and purposes, a tweezer tool constructed in accordance with the present invention includes a first, rigid arm having a first gripping end. A second, flexible arm is joined to the first arm at a point distal from the first gripping end, the flexible arm having a first gripping end generally aligned with and adjacent to the gripping end of the rigid arm, the two ends providing a tweezer jaw set. Means are provided to permit the flexing of the flexible arm with respect to the fixed arm, whereby upon such flexing the first gripping end of the flexible arm separates from its normal rest position adjacent the rigid arm to allow an item to be grasped therebetween. When the flexure of the flexible arm is released, the flexible arm attempts to return to its original position, whereby an item is grasped between the arms.

A second end of the rigid arm may be provided with an offset and a pair of fixed, slightly flexible spaced jaws to permit objects to be grasped therebetween. In addition, the first end of the rigid arm of the tool may be provided with an additional offset portion configured as a knife.

BRIEF DESCRIPTION OF DRAWINGS

A fuller understanding of the present invention will be accomplished upon consideration of the following detailed description of a preferred, but nonetheless illustrative embodiment of the invention, when reviewed in association with the annexed drawings, wherein:

FIG. 2 is a side view thereof;

FIG. 3 is a bottom plan view thereof;

FIG. 5 is a partial section view taken along line 5-5 in FIG. 4;

FIG. 13 is an elevation view of a second illustrative orientation of a peg in an orientation capable of bring gripped by the tool;

FIG. 14 is a depiction of the tool grasping the peg of FIG. 13;

FIG. 15 is a depiction of yet another orientation of a peg capable of being grasped by the tool;

DETAILED DESCRIPTION OF THE INVENTION

Figure 1:
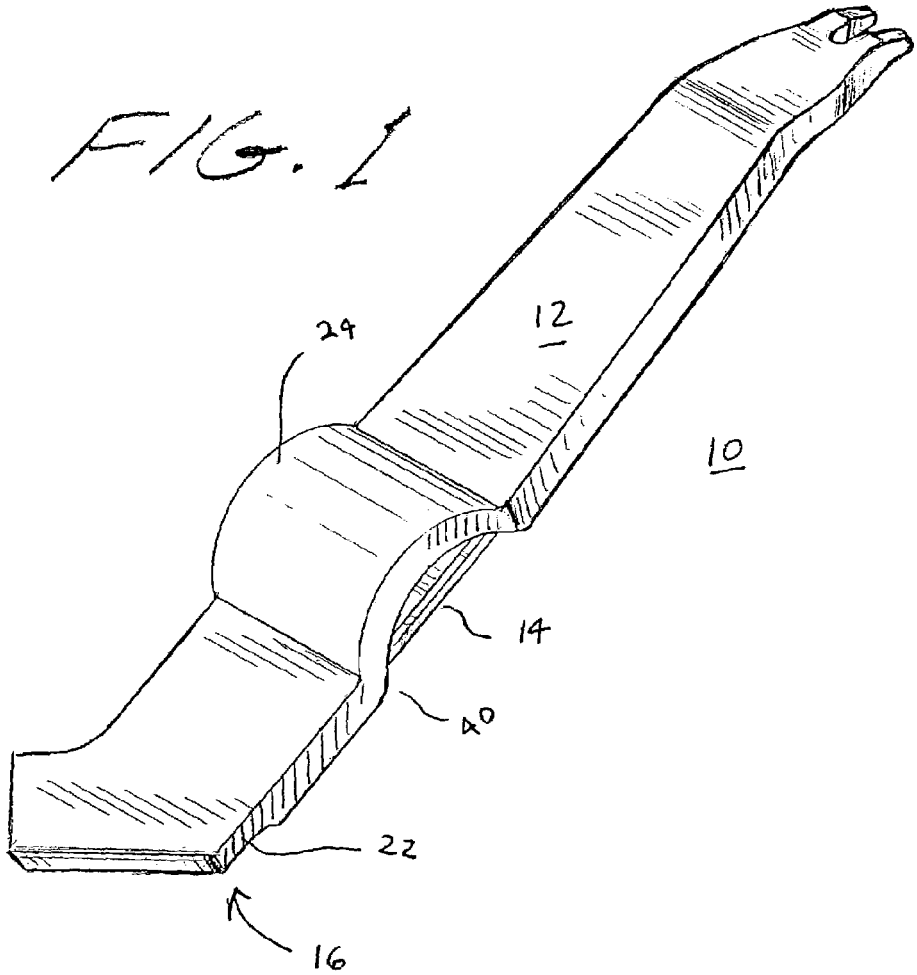
FIG. 1 is a perspective view of a tweezers tool of the invention.
Figure 4:
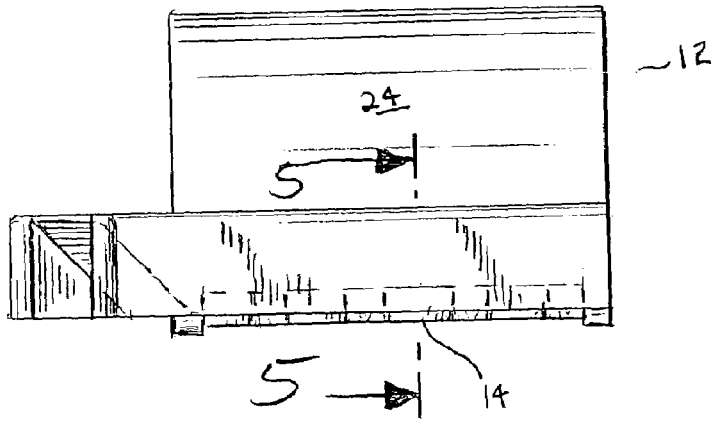
FIG. 4 is an end view taken along line 4-4 of FIG. 2.
Figure 6:
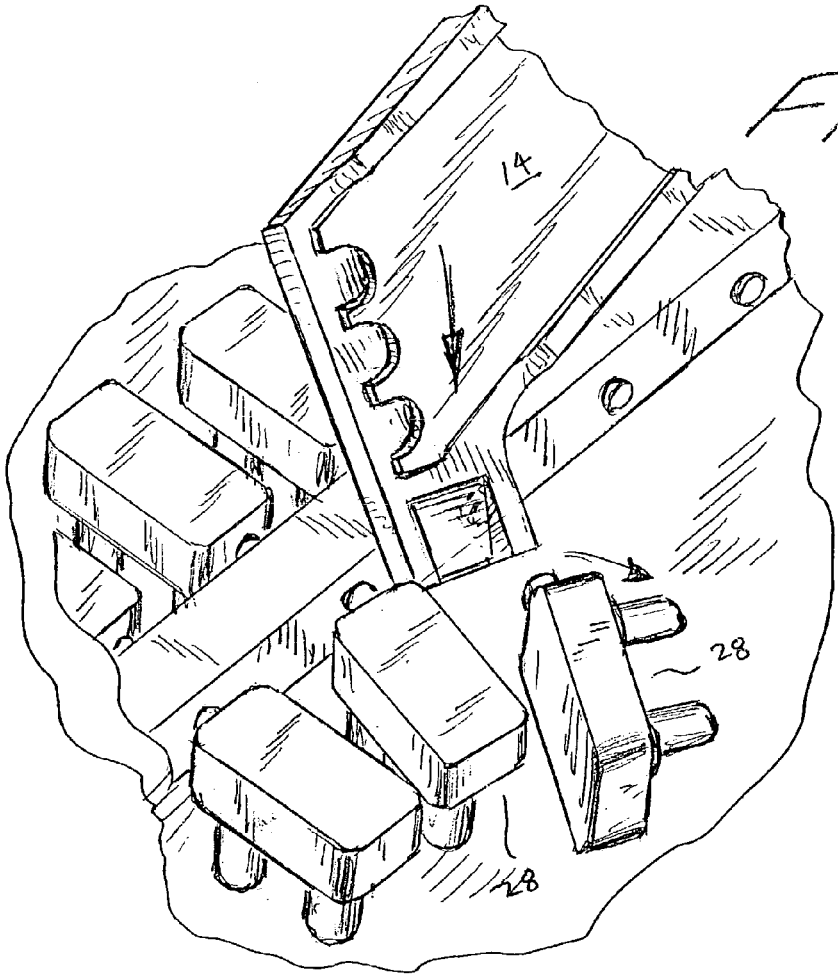
FIG. 6 is a detail perspective view of the operation of the tool in separating peg elements from a peg element support spine.

With initial reference to FIGS. 1-5, tweezer tool 10 of the present invention comprises rigid arm 12 and flexible arm 14. The generally aligned first ends of the rigid and flexible arms form a set of tweezer jaws 16. As seen in FIG. 2 and FIG. 3, the flexible arm 14 may be of lesser overall length than the rigid arm 12. The flexible arm 14 is affixed to the rigid arm 12 at a second end portion 18 of the flexible arm such as by gluing, riveting, or the like. The flexible arm also may be of narrower width than that of the rigid arm such that the flexible arm may lie in a recess 20 in the bottom surface of the rigid arm. In such a construction the side walls forming the recess may be cut away at the end of the rigid arm such that the flexible arm is more fully exposed at the tweezers' jaws.

Rigid arm 12 is constructed with a curved portion 24 between the tweezer jaws 16 and the end 18 of the flexible arm, which is affixed to the rigid arm. The curved portion 24 defines a recess 26 between the two arms which can accommodate the overlying portion of flexible arm 14 when the flexible arm is deformed as a result of a force applied to the overlying portion of the flexible arm, as will be further explained. The ends of both the rigid and flexible arms forming the tweezer jaws 16 may be angled, as may be seen in FIG. 3, to provide a more comfortable operating position for the tool when the jaws are positioned against a horizontal surface. The end of the rigid arm may also be provided with offset portion 50 configured as a knife or cutting edge.

Figure 7:
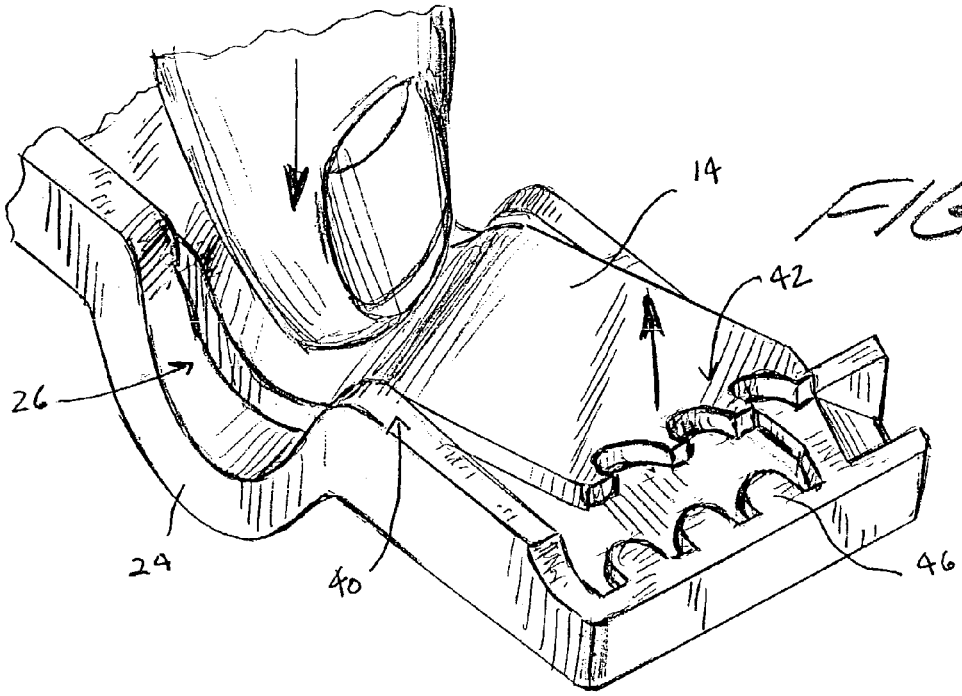
FIG. 7 is a detail perspective view showing operation of the tweezers' jaws.
Figure 8:
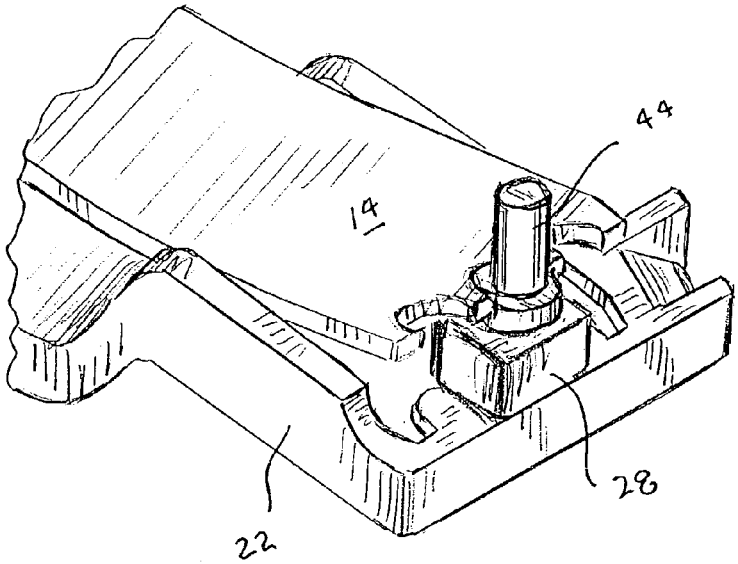
FIG. 8 is a detail perspective view showing the grasping of a peg by the tool.

As depicted in FIG. 7, when finger pressure is applied to the flexible arm 14 at a location overlying the recess 26, the arm deforms into the recess, pivoting about the forward recess ledge 40. With such deformation and pivoting the first end of the flexible arm both rises and retracts from the corresponding end of the rigid arm, resulting in a separation of the tweezer jaws as depicted. Due to the resiliency of the flexible arm, when finger pressure is removed, the flexible arm returns to its initial, straight configuration. When the open jaws are positioned about an object to be grasped, such as a peg 28 as shown in FIG. 8, and the finger pressure is removed, the peg 28 is gripped by the tweezers' jaws. The resiliency of the flexible arm 14 creating a restoring force to its initial straight position acts upon the peg, retaining the peg between the jaws after finger pressure has been removed. When release of the gripped object is desired, finger pressure is reapplied, which again pivots the flexible arm, raising and retracting its end, freeing the gripped object.

Figure 9:
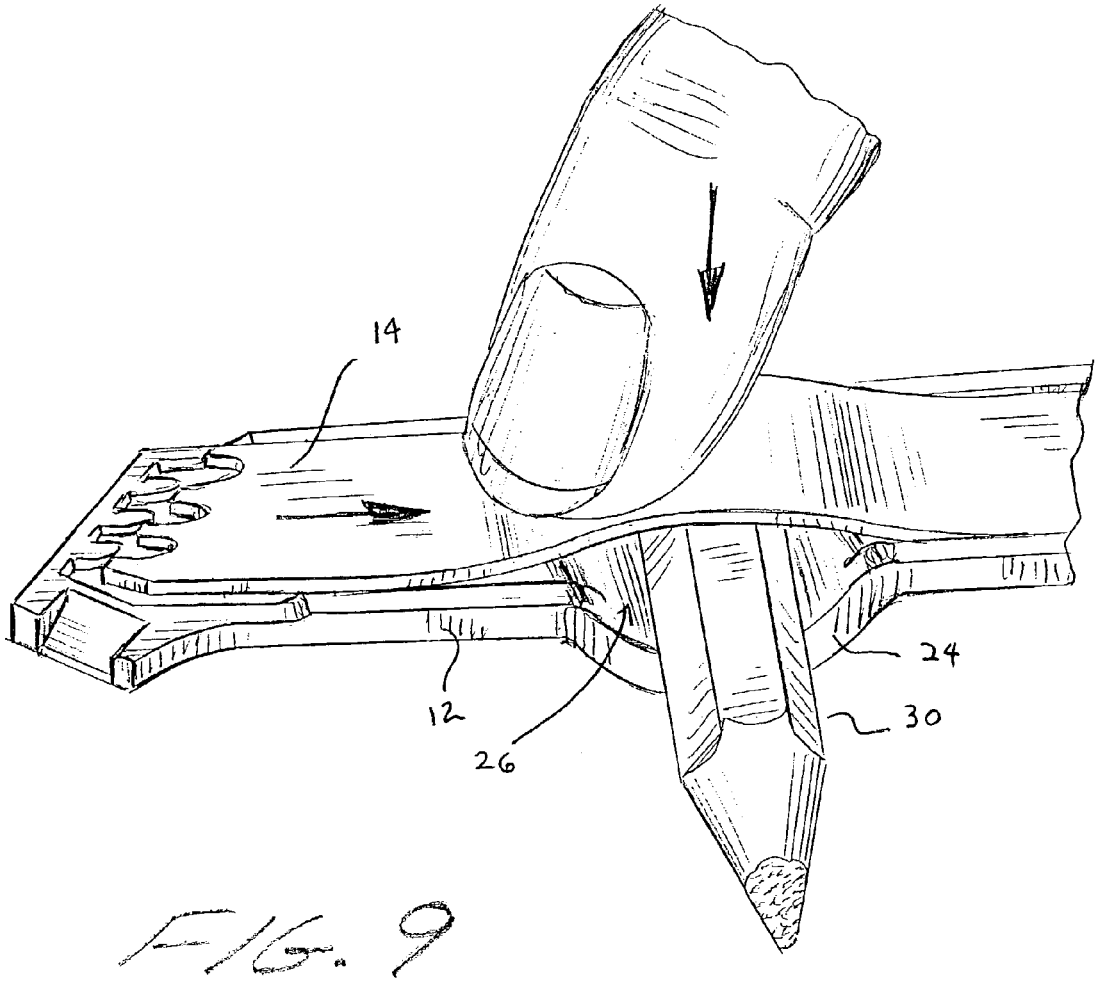
FIG. 9 is a perspective view depicting re-tensioning of the flexible arm.

After continued use, it is possible that the flexible arm 14 may retain a measure of bend or warp in the area of recess 26, thus preventing the flexible jaw from returning to a straight, planer orientation, as illustrated in FIG. 1, when finger pressure is released. Such a condition can be remedied by applying a temporary force to the flexible arm to cause the arm to flex in an opposite direction, as depicted in FIG. 9. As depicted therein, a pencil 30 or other objects having a diameter substantially larger than the depth of the recess 26 is placed in the recess between the rigid and flexible arms, thus raising the flexible arm. Finger pressure is then applied to the flexible arm about the object straightening the flexible arm from its acquired curvature and returning it to a flat configuration. The object 30 is then removed and continued proper operation of the tweezers is re-established.

In order to increase the utility of the tweezers for use in connection with peg-like elements as depicted in the figures, the first end of the flexible arm forming one of the tweezers' jaws 16 may include a series of serrations 42, as seen in FIG. 3. The serrations may conform to the shape and spacing of the pins 44 on a peg 28. To protect the serrations 42, the first end of the rigid arm 12 may be provided with a complementary raised portion 46 which mates with the serrations, as can be seen in FIG. 7. The retraction action on tweezers operation is of particular benefit with such a construction as, in addition to removing the end of the flexible arm from the path of the peg to be inserted, it protects the serrations from damage during peg insertion.

Figure 10:
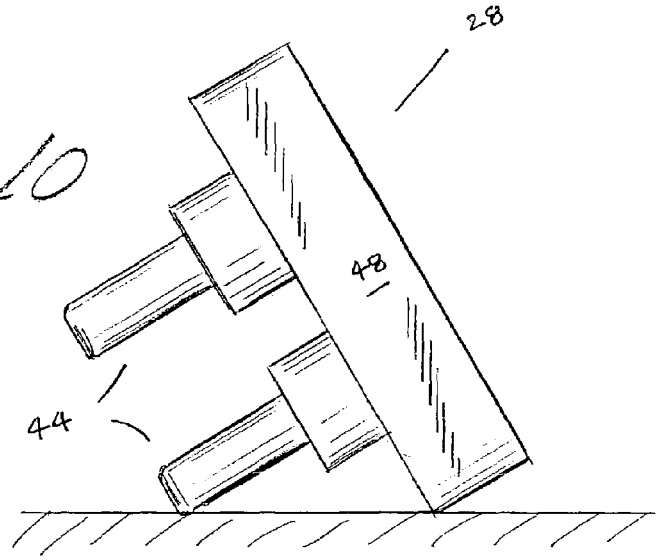
FIG. 10 is an enlarged elevation view of a peg resting on a surface in an illustrative orientation to be gripped by the tool.
Figure 11:
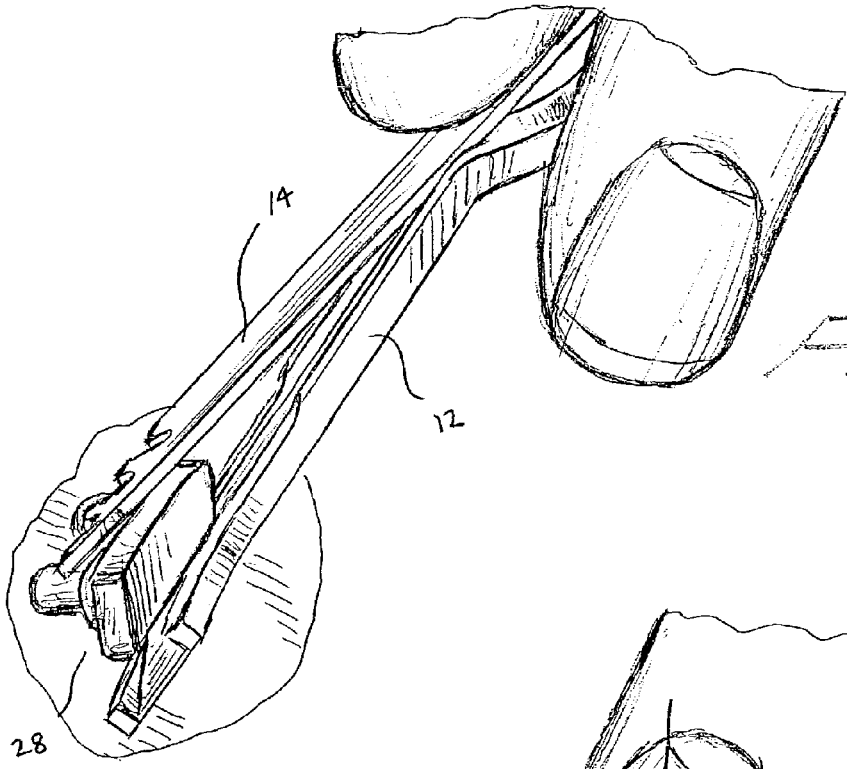
FIG. 11 is a perspective view depicting the grasping of a peg by the tool.
Figure 12:
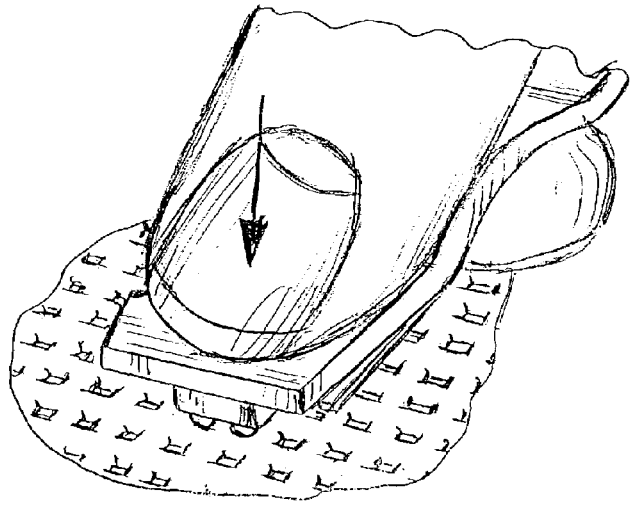
FIG. 12 is a depiction of the insertion of a peg in a grid matrix while being grasped by the tool.

FIGS. 10, 13 and 15 illustrate a variety of orientations that a peg unit 28 can take to be grasped by the tweezers of the invention. In FIG. 10 the peg unit rests on a combination of a pin 44 and its base 48. the tweezer tool grasps the peg as shown in FIG. 11, the base of the peg being contacted by the rigid arm, while the serrations of the flexible arm engage the pins.

In FIG. 13, the peg unit rests solely on its base 48. The tweezers are used to tip the peg unit onto an edge, as shown in FIG. 14, while the jaws are open to allow the flexible arm serrations to align with the peg pins.

Figure 16:
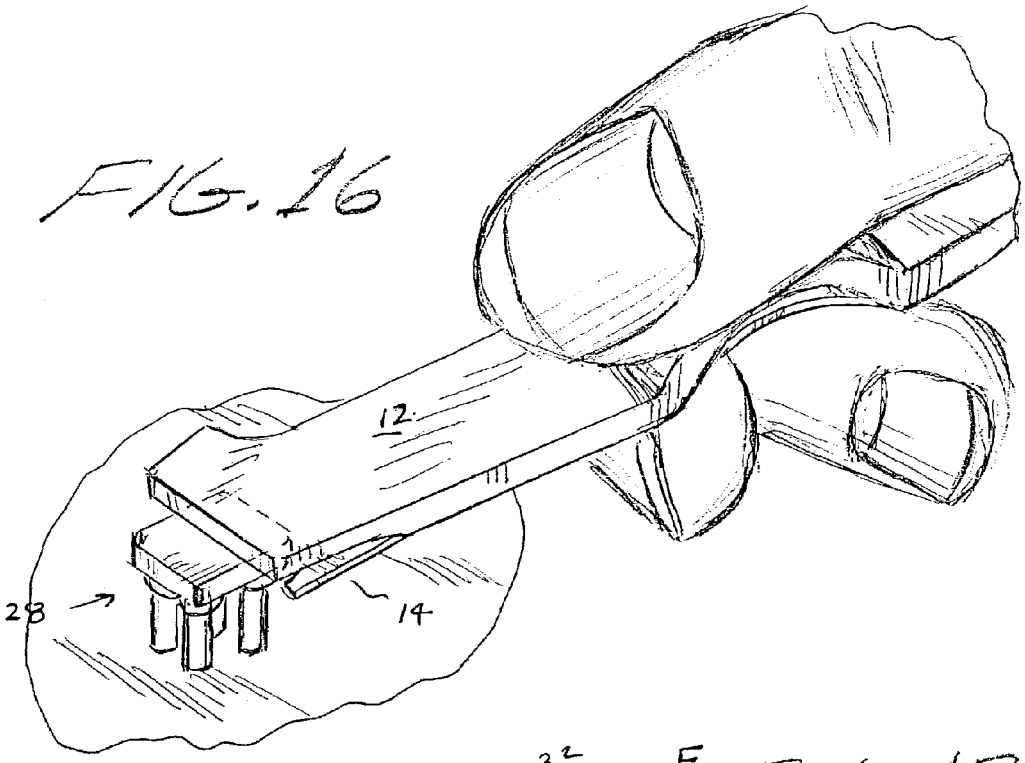
FIG. 16 is a depiction of the grasping of the peg of FIG. 15 by the tool.

FIGS. 15 and 16 depicts a peg unit resting on the pins 44. In such an orientation, the tweezers, with the jaws open, is moved horizontally, with the flexible arm below the peg base such that the serrations can again engage the peg pins.

Figure 17:
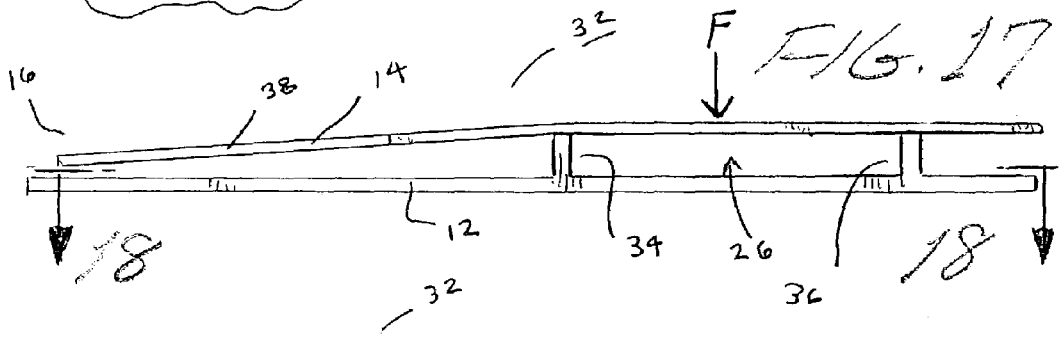
FIG. 17 is a side view of an alternative construction of the tool.
Figure 18:
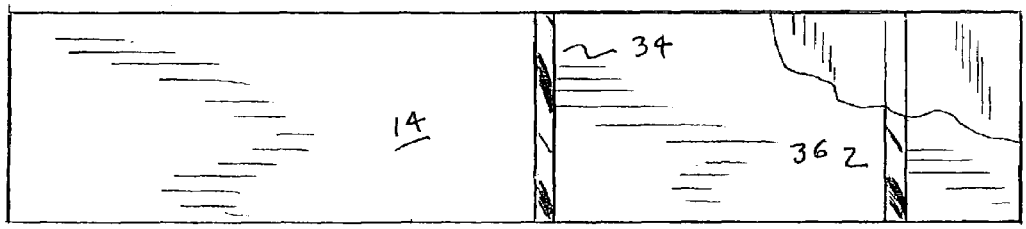
FIG. 18 is a view taken along line 18-18.

FIGS. 17 and 18 depict an alternative construction for the tweezer tool. As depicted therein, the tool 32 may comprise a rigid arm 12 and a flexible arm 14, wherein a pair of transverse flanges 34, 36 are located on the rigid arm. The flexible arm 14 is affixed to the distal flange 36, and merely rests upon the flange 34. Flexible arm 14 is provided with an inwardly bent forward portion 38 forward of the flange 34 which allows contact to be made between the ends of the arms, creating the tweezer jaw portion 16. The space between flanges 34, 36 and between the arms 12, 14 define the recess 26 into which the flexible arm 14 deforms when the operating force, as depicted by the arrow in FIG. 17, is applied.

I claim:

1. A tweezers, comprising:

a first arm;

a second arm joined to the first arm at a joint, the first and second arms each having an adjacent distal end forming a pair of normally-closed tweezers jaws;

said second arm having a portion capable of being locally deformed by finger pressure applied to the deformable portion in a direction towards the first arm and returnable to a generally undeformed state when said pressure is removed;

said first arm having an outwardly-directed recess for accommodating the deformable portion of the second arm when deformed;

the deformable portion of the second arm generally overlying said recess and deforming when a force is applied to said overlying deformable portion thereby causing a second portion of said second arm extending from said distal end to said recess to be displaced and pivoted away from the first arm and its distal end to open the tweezers jaws, a third portion of said second arm extending from said joint to said recess not being displaced or retracted by said force; and the deformable portion of said second arm returning to an undeformed orientation and the second portion and distal end of the second arm returning towards the first arm to close the tweezer jaws when the force is removed.

2. The tweezers of claim 1 wherein the recess is formed by a curved portion of the first arm.

3. The tweezers of claim 1 wherein the second arm is bounded by a pair of flanges on the first arm.

4. A tweezers, comprising:

a first arm;

a second arm joined to the first arm at a joint, the first and second arms each having an adjacent distal end forming tweezers jaws;

said second arm having a portion capable of being locally deformed by finger pressure in a direction towards the first arm and returnable to a generally undeformed state when said pressure is removed; and a recess located in the first arm and between the joint and tweezers jaws extending away from the second arm for accommodating the deformable portion of the second arm generally overlying said recess when the deformable portion is deformed by finger pressure exerted thereon, the first arm having a forward edge adjacent the recess against which the second arm bears, a forward portion of the second arm pivoting and sliding rearwardly over the forward edge to pivot the second arm distal end about the forward edge back and away from the distal end of the first arm to open the tweezers jaws, a portion of said second arm from said joint to said recess not being displaced or retracted when said pressure is applied.

5. The tweezers of claim 4 wherein the recess is formed by a curved portion of the first arm.

6. The tweezers of claim 4 wherein the recess is formed by a linear portion of the first arm bounded by a pair of flanges on the first arm, the forward edge being formed by one of the flanges.

7. The tweezers of claim 4 wherein the tweezers jaws include an offset cutting edge.

8. The tweezers of claim 7 wherein the cutting edge is bounded by a pair of lateral protective shoulders.

9. The tweezers of claim 8 wherein the cutting edge and shoulders are integral with the first arm.

10. The tweezers of claim 4 wherein the distal end of the second arm is serrated.

11. The tweezers of claim 10 wherein the distal end of the first arm includes embossments complementary to the serrated distal end of the second arm.

12. The tweezers of claim 4 wherein the first arm has a second end having a tool head attached thereto.

* * * * *